US006292637B1

(12) United States Patent
Lindblad et al.

(10) Patent No.: US 6,292,637 B1
(45) Date of Patent: Sep. 18, 2001

(54) BLADE FOR REMOVING ELECTRICALLY CHARGED PARTICLES FROM THE BACK SIDE OF A BELT IN AN ELECTROSTATOGRAPHIC APPARATUS

(75) Inventors: Nero R. Lindblad, Ontario; James M. Casella; James C. Diehl, both of Webster, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/533,284

(22) Filed: Mar. 22, 2000

(51) Int. Cl.[7] ..... G03G 21/00

(52) U.S. Cl. ..... 399/99; 399/350; 399/351

(58) Field of Search ..... 399/98, 99, 100, 399/123, 165, 162, 167, 350, 351, 349, 273, 283; 15/256.51, 256.52

(56) References Cited

U.S. PATENT DOCUMENTS

| | | | | |
|---|---|---|---|---|
| 4,853,741 | | 8/1989 | Ku | 355/300 |
| 5,634,185 | * | 5/1997 | Lindblad et al. | 399/349 |
| 5,655,205 | | 8/1997 | Ziegelmuller et al. | 399/350 |
| 5,842,102 | * | 11/1998 | Montfort et al. | 399/349 |
| 6,016,415 | * | 1/2000 | Herrick et al. | 399/162 |
| 6,088,559 | * | 7/2000 | Costanza et al. | 399/165 |

* cited by examiner

*Primary Examiner*—Sophia S. Chen
*Assistant Examiner*—Hoan Tran
(74) *Attorney, Agent, or Firm*—Linda M. Robb

(57) ABSTRACT

An apparatus for removing electrostatically charged particles from a surface such as the backside of an image bearing belt of the type found in an electrostatographic printing apparatus or a drive roller supporting an image bearing belt. The apparatus includes an electrically biased cleaning blade, a supporting device, and a housing for storing the particles removed from the surface by the cleaning blade.

20 Claims, 4 Drawing Sheets

BLADE FOR REMOVING ELECTRICALLY CHARGED PARTICLES FROM THE BACK SIDE OF A BELT IN AN ELECTROSTATOGRAPHIC APPARATUS

CROSS REFERENCE TO RELATED APPLICATIONS

The following application, U.S. application Ser. No. 09/533,881, filed Mar. 22, 2000, entitled "BLADE FOR CLEANING SPOTS AND FILM FROM A SURFACE" is assigned to the same assignee of the present application. The entire disclosures of this copending application are totally incorporated herein by reference in their entirety.

BACKGROUND OF THE INVENTION

This invention relates generally to an electrostatographic printer or copier, and more particularly concerns a device for cleaning the backside of a photoreceptor belt used therein.

In an electrophotographic application such as xerography, a charge retentive surface (i.e., photoconductor, photoreceptor or imaging surface) is electrostatically charged and exposed to a light pattern of an original image to be reproduced to selectively discharge the surface in accordance therewith. The resulting pattern of charged and discharged areas on that surface form an electrostatic charge pattern (an electrostatic latent image) conforming to the original image. The latent image is developed by contacting it with a finely divided, electrostatically attractable powder referred to as "toner". Toner is held on the image areas by the electrostatic charge on the surface. Thus, a toner image is produced in conformity with a light image of the original being reproduced. The toner image may then be transferred to a substrate (e.g., paper), and the image affixed thereto to form a permanent record of the image to be reproduced. Subsequent to development, excess toner left on the charge retentive surface is cleaned from the surface. This process is well known, and useful for light lens copying from an original, and printing applications from electronically generated or stored originals, where a charged surface may be image-wise discharged in a variety of ways. Ion projection devices where a charge is image-wise deposited on a charge retentive substrate operate similarly.

One type of charge retentive surface typically utilized in the electrostatographic reproduction device is a photoreceptor belt having a base of flexible material. The photoreceptor belt is entrained about a plurality of support rollers so as to form a closed loop path. The photoreceptor belt is driven about the closed loop path to present particular areas of the photoreceptor belt sequentially into association with electrographic process stations to form desired reproductions. Adhered to the backside of the photoreceptor belt is a substrate polycarbonate known as anti curl back coating. The purpose of this coating is to balance the stresses within the photoreceptor belt and control edge curling. Over time as a photoreceptor belt repeatedly travels around the sharp corners of rollers, backer bars, and other surfaces, the anti curl back coating begins to wear and flake off in the form of low charged negative particles. As a result, a build up of anti curl back coating particles occurs on all parts of the module which come in contact with the anti curl back layer. In particular, there is a buildup of anti curl back coating particles on the drive roller, on the back of the belt, the backer bars, and in the Acoustic Transfer Assist (ATA). Debris particles on the drive roll cause the coefficient of friction of the drive roller to drop appreciably. The buildup of debris particles on the backside of the photoreceptor belt also adversely affects drive roll friction and the drive performance of the photoreceptor belt as it is driven about the closed loop path and, ultimately, overall performance of the reproduction apparatus. In a non-contact development system, such as Hybrid Scavengeless Development (HSD), the spacing between the developer and the imaging surface is important. When debris builds up on the developer backer bars, the photoreceptor is lifted off the backer bars, thereby causing the spacing in the development nip to decrease. When this occurs in a particular location, or several different locations on the developer backer bars, the different development fields produce streaks on copy in the process direction. Excessive debris in the ATA reduces the suction pressure in the ATA and creates transfer defects.

Several mechanisms have been employed for cleaning the backside of the photoreceptor belt. One mechanism includes a stationary pad of a material such as cotton. This pad can easily become saturated with debris, with the period of time required for the pad to become saturated not readily predictable. Saturation of the pad can cause excessive abrasion and scratching of the photoreceptor belt, necessitating frequent inspection and cleaning. To meet high volume copier applications, a cleaner for the backside of a photoreceptor belt or the drive roller is needed that would preserve drive capacity and prevent anti curl back coating contamination to sensitive subsystems.

The following disclosures may be relevant to various aspects of the present invention and may be briefly summarized as follows:

U.S. Pat. No. 4,853,741 to Ku utilizes an indexing web of material, such as a fabric of a non-woven blend of polyester and rayon for example. The web is periodically indexed by a motor, which is coupled to the mechanism. While this mechanism reduces the necessity for frequent inspection, it may scratch the dielectric support web if it picks up any abrasive particles or debris.

U.S. Pat. No. 5,655,205 to Ziegelmuller et al. discloses a mechanism for cleaning the backside of an image bearing dielectric support web including a cleaning blade which engages the backside of the dielectric support web at a predetermined angle so as to wipe the backside of the web. A catch tray attached to the blade collects debris removed from the backside of the web.

SUMMARY OF THE INVENTION

Briefly stated, and in accordance with one aspect of the present invention, there is provided an apparatus for removing electrostatically charged particles from a surface such as the back side of an image bearing belt of the type found in an electrostatographic printing apparatus or a drive roller supporting an image bearing belt. The apparatus includes an electrically biased conductive cleaning blade, a supporting device, and housing for storing the particles removed from the surface by the cleaning blade.

In accordance with another aspect of the present invention, there is provided a printing machine of the type having a photoconductive member in the form of an image bearing belt and a housing for storing particles which accumulate on the backside of the image bearing belt or the drive roller supporting the image bearing belt. The apparatus for removing accumulated particles includes an electrically biased conductive cleaning blade, which contacts the surface to be cleaned and a supporting device.

BRIEF DESCRIPTION OF THE DRAWINGS

The foregoing and other features of the instant invention will be apparent and easily understood from a further reading of the specification, claims and by reference to the accompanying drawings in which:

All references cited in this specification, and their references, are incorporated by reference herein where appropriate for teaching additional or alternative details, features, and/or technical background.

While the present invention will be described hereinafter in connection with a preferred embodiment thereof, it should be understood that it is not intended to limit the invention to that embodiment. On the contrary, it is intended to cover all alternatives, modifications and equivalents as may be included within the spirit and scope of the invention as defined in the appended claims.

DETAILED DESCRIPTION OF THE INVENTION

Figure 1:
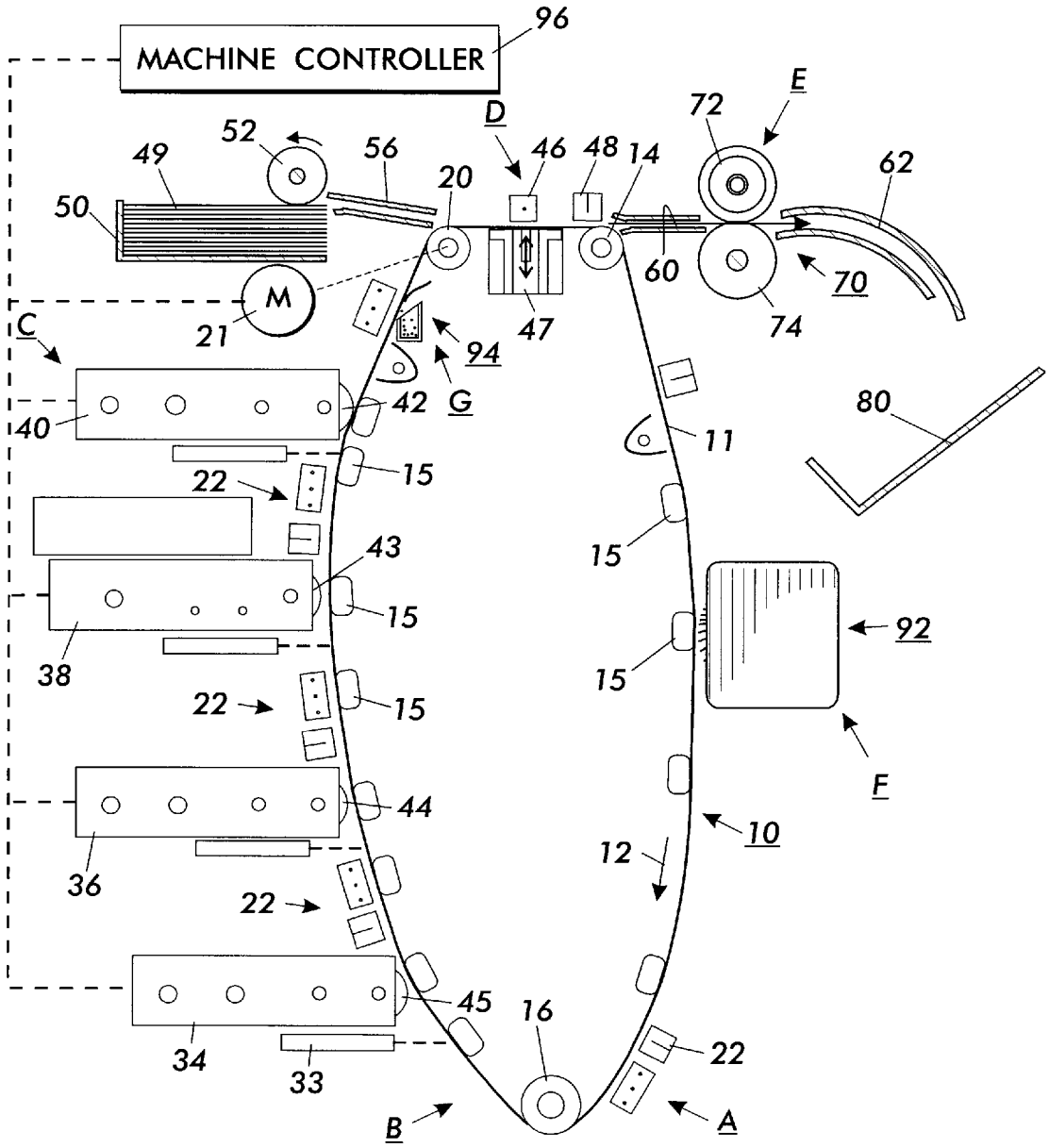
FIG. 1 is a schematic illustration of a printing apparatus incorporating the inventive features of the present invention.

For a general understanding of an electrophotographic printer or copier, in which the present invention may be incorporated, reference is made to FIG. 1, which depicts schematically the various components thereof. Hereinafter, like reference numerals have been used through out to identify identical elements. Although the blade cleaner apparatus of the present invention is particularly well adapted for use in an electrophotographic printing machine, it should become evident from the following discussion that it is equally well suited for use in other applications and is not necessarily limited to the particular embodiment shown herein.

Referring now to the drawings, the various processing stations employed in the reproduction machine illustrated in FIG. 1 will be described briefly hereinafter. It will no doubt be appreciated that the various processing elements also find advantageous use in electrophotographic printing applications from an electronically stored original, and with appropriate modifications, to an ion projection device which deposits ions and image configuration on a charge retentive surface.

A reproduction machine, in which the present invention finds advantageous use, has a photoreceptor belt 10, having a photoconductive (or imaging) surface 11. The photoreceptor belt 10 moves in the direction of arrow 12 to advance portions of the belt 10 sequentially through the various processing stations disposed about the path of movement thereof. The belt 10 is entrained about a stripping roller 14, a tension roller 16, a drive roller 20, and backer bars indicated generally as 15. Drive roller 20 is coupled to a motor 21 by suitable means such as a belt drive. The belt 10 is maintained in tension by a pair of springs (not shown) resiliently urging tension roller 16 against the belt 10 with the desired spring force. Both stripping roller 14 and tension roller 16 are rotatably mounted. These rollers are idlers, which rotate freely as the belt 10 moves in the direction of arrow 12.

With continued reference to FIG. 1, initially a portion of the belt 10 passes through charging station A. At charging station A, a corona device 22 charges a portion of the photoreceptor belt 10 to a relatively high, substantially uniform potential, either positive or negative. At exposure station B, a Raster Output Scanner (ROS) 33 exposes the charged portions of photoreceptor belt 10 to record an electrostatic latent image thereon.

Thereafter, the belt 10 advances the electrostatic latent image to developing station C. At development station C, a developer housing 34, 36, 38, or 40 is brought into contact with the belt 10 for the purpose of developing the electrostatic latent image. Each developer housing 34, 36, 38, and 40 supports a developing system such as magnetic brush rolls 42, 43, 44, and 45, which provides a rotating magnetic member to advance developer mix (i.e. carrier beads and toner) into contact with the electrostatic latent image. The electrostatic latent image attracts toner particles from the carrier beads, thereby forming toner powder images on the photoreceptor belt 10.

The photoreceptor belt 10 then advances the developed image to transfer station D. At transfer station D, a sheet of support material such as paper copy sheets is advanced into contact with the developed images on the belt 10. A corona generating device 46 charges the copy sheet to the proper potential so that it becomes tacked to the photoreceptor belt 10 and the toner powder image is attracted from the photoreceptor belt 10 to the sheet. Acoustic Transfer Assist device 47 provides vibrational energy to photoreceptor belt 10 at a frequency sufficient to assist in loosening the toner powder image and thereby facilitating transfer of the image to the sheet. After transfer, the corona generator 48 charges the copy sheet to an opposite polarity to de-tack the copy sheet from the belt 10, whereupon the sheet is stripped from the belt 10 at stripping roller 14.

Sheets of support material 49 are advanced to transfer station D from a supply tray 50. Sheets are fed from tray 50, with sheet feeder 52, and advanced to transfer station D along conveyor 56.

After transfer, the sheet continues to move in the direction of arrow 60, to fusing station E. Fusing station E includes a fuser assembly indicated generally by the reference numeral 70, which permanently affixes the transfer toner powder images to the sheets. Preferably, the fuser assembly 70 includes a heated fuser roller 72 adapted to be pressure engaged with a backup roller 74 with the toner powder images contacting the fuser roller 72. In this manner, the toner powder image is permanently affixed to the sheet, and such sheets are directed via a chute 62 to an output 80 or finisher.

Residual particles, remaining on the image side of photoreceptor belt 10 after each copy is made, may be removed at cleaning station F, represented by the reference numeral 92. At cleaning station 92 residual toner particles are removed and may also be stored for disposal.

Residual particles, collecting on the backside of photoreceptor belt 10, may be removed at back of belt cleaning station G. The cleaning apparatus of the present invention is represented by the reference numeral 94, which will be described in greater detail in FIGS. 3–4. Removed residual particles may also be stored for disposal.

A machine controller 96 is preferably a known programmable controller or combination of controllers, which conventionally control all of the machine steps and functions described above. The controller 96 is responsive to a variety of sensing devices to enhance control of the machine, and also provides connection diagnostic operations to a user interface (not shown) where required.

Figure 2:
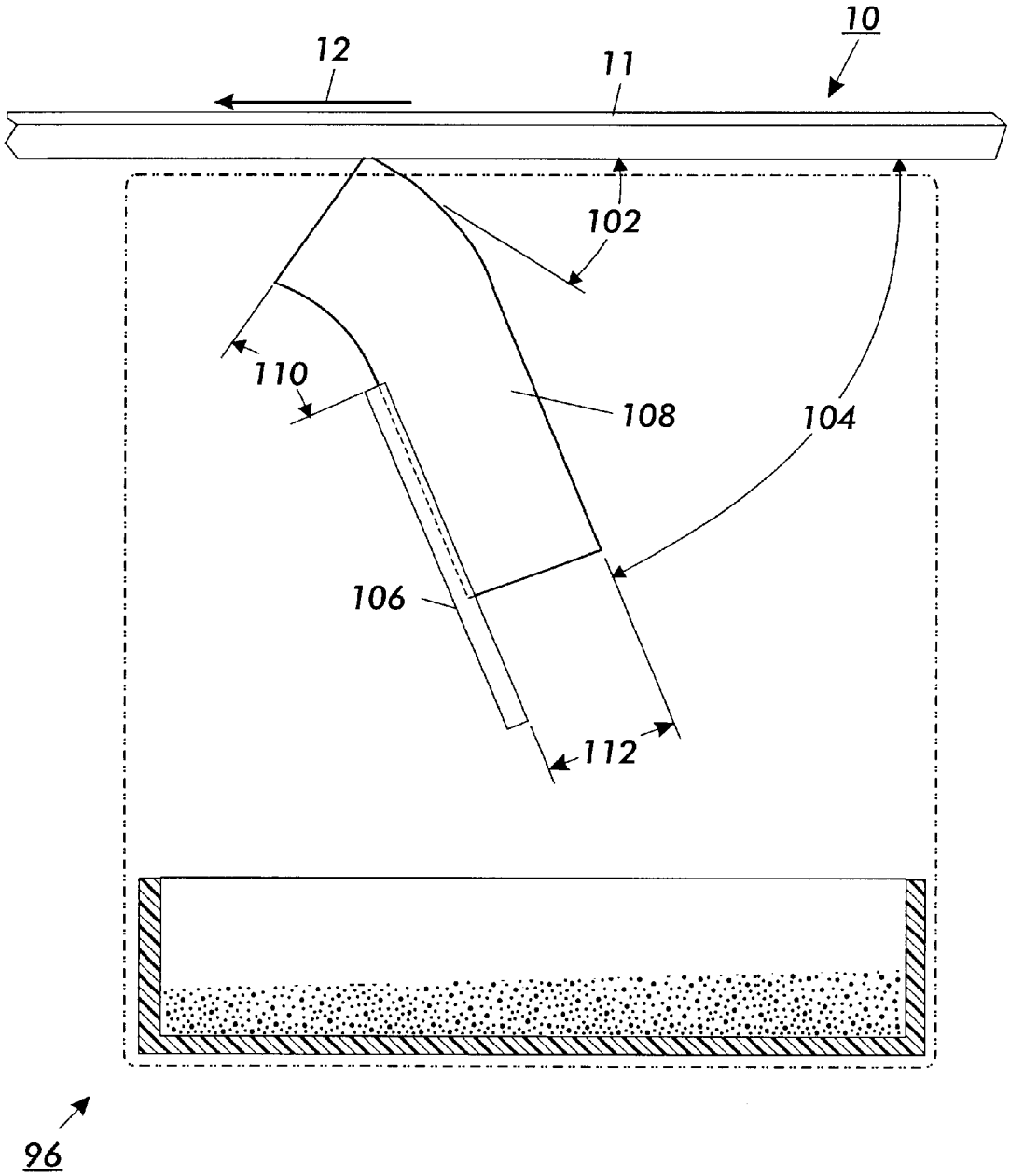
FIG. 2 (PRIOR ART)
FIG. 2 is an elevational view of the prior art.
Figure 3:
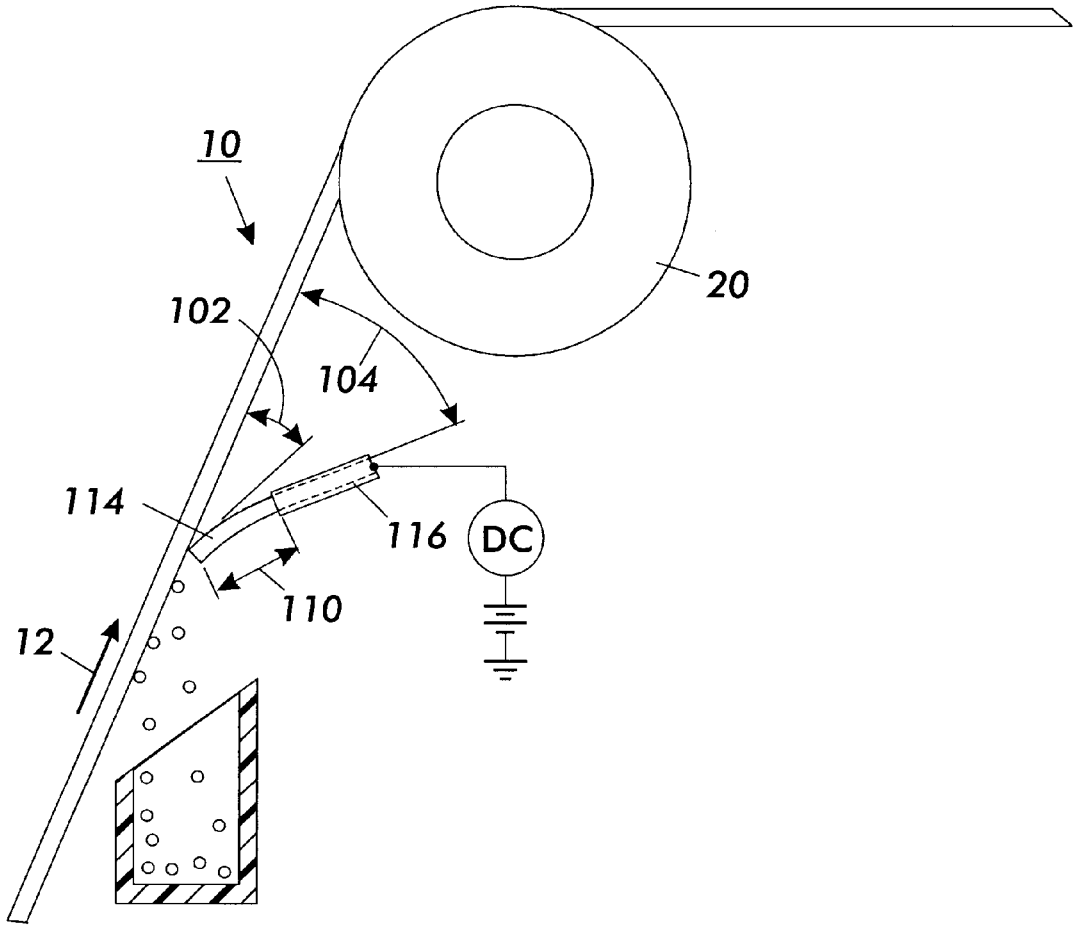
FIG. 3 is an elevational view of an embodiment of the present invention.
Figure 4:
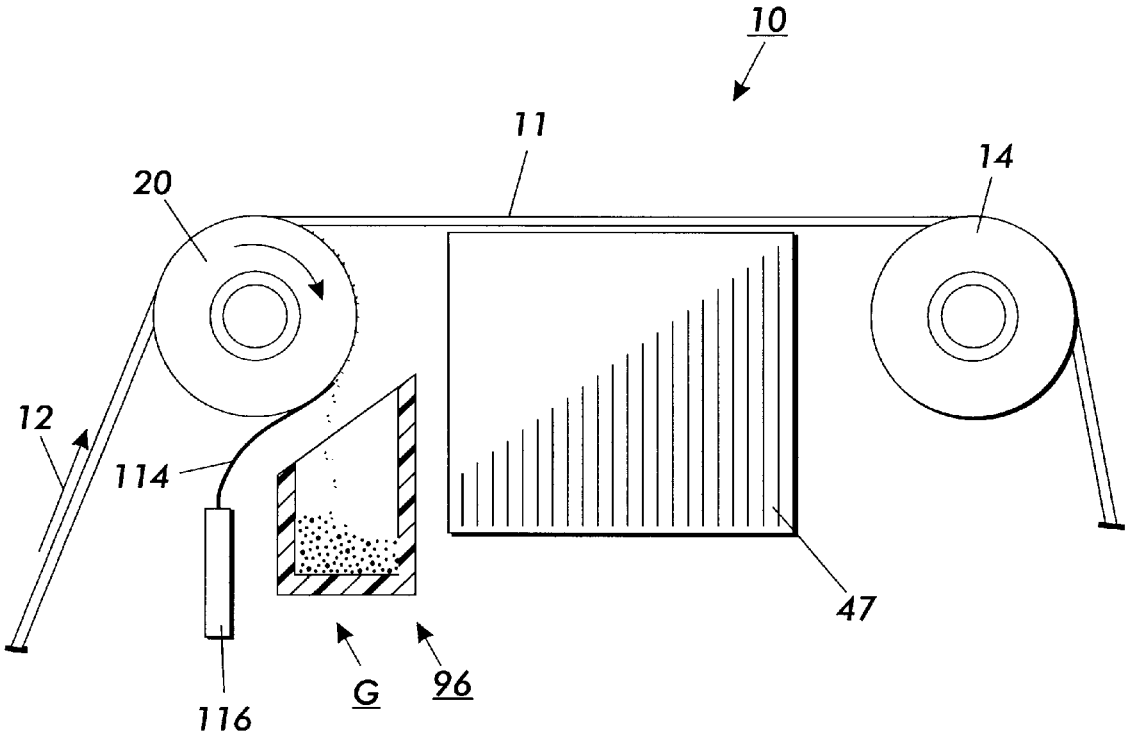
FIG. 4 is an elevational view of still another embodiment of the present invention.

As thus described, a reproduction machine in accordance with the present invention may be any of several well-known devices. Variations may be expected in specific electrophotographic processing, paper handling and control arrangements without effecting the present invention. However, it is believed that the foregoing description is sufficient for purposes of the present application to illustrate the general operation of an electrophotographic-printing machine, which exemplifies one type of apparatus employing the present invention therein. Reference is now made to FIGS. 2–4, where the showings are for the purpose of illustrating preferred embodiments of the present invention and not for limiting the same.

Wear debris accumulates on the back side of the photoreceptor belt and the drive roller as the result of movement of the photoreceptor belt over the backer bars and rollers supporting the photoreceptor belt. Adhesion of the debris to the back of the belt is low because particle charge is low (0 to −10 $\mu$coul/gm) and the particle size is larger (10 to 200 microns). It is fortunate that the debris particles do not triboelectrically charge to high values as they rub against many different surfaces. A high charge on the debris particles would make cleaning more difficult. The large particle size is caused by the agglomeration of particles as they are squeezed through the contact nips between the back of the belt and the backer bars, the steel rolls, and the ATA plenum surface. Heat generated in these contact sliding nips also encourages the agglomeration of particles. If these particles are not continuously removed, the heat eventually starts to cause the particles to fuse to all the elements. Therefore, it is necessary to remove the debris particles from the back of the belt from the outset. The low adhesion of the debris particles enables easy removal using simple mechanical, electrical or electro-mechanical means. The blade cleaner of the present invention employs a combination of electrical and mechanical forces to detach and remove debris from the backside of the photoreceptor belt.

Reference is now made to FIG. 2, which shows a side elevational view of the prior art (U.S. Pat. No. 5,655,205) with portions broken away or removed to facilitate viewing of the blade configuration. The relatively thick urethane blade 108 is positioned adjacent to and transversely across the backside of the photoreceptor belt 10 in a wiping mode. To achieve sufficient force to remove particles from the photoreceptor belt in the wiping mode, the prior art employs a relatively thick soft urethane blade with a stiffening member 106 and a short blade extension 110 (0.000–0.200 inches) from the blade holder. The prior art blade thickness 112 is typically 0.100–0.200 inches. The blade holder angle 104 is in the range of 60°–80°. The combination of the short extension, thick soft urethane blade and stiffening member results in a high blade friction force of approximately 50 gm/cm being applied to the photoreceptor belt during operation. This creates a stick-slip motion referred to as flutter, which affects the motion quality of the photoreceptor belt.

Reference is now made to FIG. 3, which shows a side elevational view of the present invention, with portions broken away or removed to facilitate viewing of the blade configuration. The relatively thin (0.010–0.040 inch thickness) blade 114 is positioned in a blade holder 116 adjacent to and transversely across the backside of the photoreceptor belt 10 in a doctoring mode, in which the cleaning blade edge acts to scrape, or "shear" particles from the back side of the photoreceptor belt. Because the adhesion between the urethane and the back of the photoreceptor belt is high, use of a soft urethane in the doctoring mode could result in the blade folding over, stick-slip motion (blade chatter or flutter) and failure of the blade to operate properly. Consequently the blade 114 of the present invention is formed of a hard urethane or other hard conductive plastic or metal. These materials have low friction when the blade force is low (5 to 10 gm/cm).

In order to exert an electrostatic force on the low charged debris particles, an electric potential is applied to the conductive blade. The applied potential has the same polarity as the low charge debris particles on the back of the belt. This creates a repulsive force that repels the charged debris particles away from the blade. The repulsive force experienced by the debris particles exceeds the small adhesion force between the debris particles and the backside of the photoreceptor belt and detaches the particles.

There are two main advantages of a biased conductive blade. First, it permits an electric bias to be applied to the blade, which aids in cleaning. Second, the biased conductive blade can also be used to discharge the back of the belt. When the back of the belt slides over the backer bars and ATA plenum surface, the back of the belt charges to a value in the range from 400 to 700 volts. Controlling the charge on the back of the photoreceptor belt is essential for two reasons. The amount of debris, which collects on the back of the belt, increases as the voltage carried by the belt increases. Reducing the voltage on the back of the belt reduces the amount of debris deposited on all elements touching the back of the belt. Also, if the belt is not discharged, the electrostatic attraction between the belt and the grounded backer bars and steel rolls makes it difficult to remove the belt from the module. With a biased conductive blade the back of the belt can be discharged to suitable levels by using a bias polarity that is opposite to the charge on the back of the belt. The ability to discharge the back of the photoreceptor belt is one of the main advantages of using a biased conductive blade material. It is important to note that the conductive blade also cleans debris even if it is grounded because the adhesion of the debris particles to the back of the belt is low. However, in such a case the charge on the back of the belt cannot be discharged effectively. A further point to note is that the low adhesion of the debris particles also allows the use of a hard urethane blade to remove the debris particles. When a grounded conductive blade or a hard urethane is used, other means need to be used to reduce the charge on the back of the belt.

In contrast to the prior art, in the doctoring mode of the present invention the blade holder angle 104 is 10°–20°, the working angle 102 is 0°–5°, and the extension 110 of blade 114 is from 10 to 18 mm, depending on the material and thickness of the blade. This results in a much lower blade force of approximately 5–10 gm/cm applied to the back of the belt and reduces wear to both the blade and the back of the belt.

As may be appreciated by one skilled in the art, the embodiment illustrated in FIG. 3 may also be configured to remove debris particles accumulating on drive roller 20, which supports photoreceptor belt 10, or on other surfaces which contact the backside of photoreceptor belt 10. Reference is now made to FIG. 4, which illustrates a second embodiment of the present invention configured to remove debris particles from drive roller 20, as an example of one such configuration. As shown in FIG. 4, the blade 114 is in operable contact with drive roller 20. The blade 114 may be comprised of a hard urethane, conductive plastic, or metal material. The conductive material may be electrically biased to suitable magnitude to enhance the cleaning process. The blade 114 operates in a doctoring mode, opposed to the movement of drive roller 20, which rotates in direction 170. As drive roller 20 rotates, blade 114 removes debris particles from the drive roller. The charge of the debris particles on the drive roll is also low. Therefore, a grounded conductive blade material or a hard urethane may be used. When gravity is employed to collect the debris, the particles will fall into the waste container for storage.

It is therefore apparent that there has been provided, in accordance with the present invention, a blade for removing electrostatically charged particles from a surface that fully satisfies the aims and advantages set forth hereinabove. While this invention has been described in conjunction with specific embodiments thereof, it will be evident to those skilled in the art that many alternatives, modifications, and variations are possible to achieve the desired results. Accordingly, the present invention is intended to embrace all such alternatives, modifications, and variations which may fall within the spirit and scope of the following claims.

What is claimed:

1. An apparatus for removing particles from a non-image-bearing surface, comprising:

a cleaning blade having an edge positioned relative to the surface so that forces on the surface shearingly remove particles from the surface;

a supporting device for supporting said cleaning blade in contact with the surface, and wherein said cleaning blade extends beyond said supporting device a distance preferably ranging from about 10 to 18 mm;

a housing for storing the particles cleaned from the surface; and means for electrically biasing said cleaning blade.

2. The apparatus according to claim 1, wherein the surface comprises a drive roller adapted for use with an image-bearing belt.

3. The apparatus according to claim 1, wherein said housing comprises a waste container.

4. The apparatus according to claim 1, wherein said cleaning blade comprises a material which causes said cleaning blade to be substantially hard.

5. The apparatus according to claim 4, wherein said material of said cleaning blade comprises a polyurethane having a hardness preferably ranging from about 90 to about 120 Shore A.

6. The apparatus according to claim 4, wherein said material of said cleaning blade comprises a plastic having a hardness preferably ranging from about 60 to about 90 Rockwell M.

7. The apparatus according to claim 4, wherein said material of said cleaning blade comprises a metal having a hardness preferably ranging from about 50 to about 60 Rockwell C.

8. The apparatus according to claim 1, wherein said cleaning blade edge forms a working angle with said surface, said working angle preferably ranging from about 0° to about 5°.

9. The apparatus according to claim 1, wherein said cleaning blade has a thickness, said thickness ranging from about 0.010 inch to about 0.040 inch.

10. The apparatus according to claim 1, wherein said cleaning blade in contact with the surface applies a force, said force ranging from about 5 gm/cm to about 10 gm/cm.

11. A printing machine of the type having a photoconductive member in the form of an endless dielectric belt entrained about a supporting device including a drive roller, wherein the improvement comprises:

a cleaning blade, having an edge positioned relative to a non-image-bearing surface within the printing machine so that forces on the surface shearingly remove particles from the surface;

a blade supporting device for supporting said cleaning blade in contact with said surface, and wherein said cleaning blade extends beyond said blade supporting device a distance preferably ranging from about 10 to 18 mm;

a housing for storing the particles removed from the surface; and means for electrically biasing said cleaning blade.

12. The printing machine according to claim 11, wherein the non-image-bearing surface comprises said drive roller adapted for use with said endless dielectric belt.

13. The printing machine according to claim 11, wherein said housing comprises a waste container.

14. The printing machine according to claim 11, wherein said cleaning blade is formed of a material which causes said cleaning blade to be substantially hard.

15. The printing machine according to claim 14, wherein said cleaning blade comprises a polyurethane having a hardness preferably ranging from about 90 to about 120 Shore A.

16. The printing machine according to claim 14, wherein said cleaning blade comprises a plastic having a hardness preferably ranging from about 60 to about 90 Rockwell M.

17. The printing machine according to claim 14, wherein said cleaning blade comprises a metal having a hardness preferably ranging from about 50 to about 60 Rockwell C.

18. The printing machine according to claim 11, wherein said cleaning blade edge forms a working angle with said non-image-bearing surface, said working angle preferably ranging from about 0° to about 5°.

19. The printing machine according to claim 11, wherein said cleaning blade has a thickness, said thickness ranging from about 0.010 inch to about 0.040 inch.

20. The printing machine according to claim 11, wherein said cleaning blade in contact with said non-image-bearing surface applies a force, said force ranging from about 5 gm/cm to about 10 gm/cm.

* * * * *